US008830079B2

(12) United States Patent
Smith et al.

(10) Patent No.: US 8,830,079 B2
(45) Date of Patent: Sep. 9, 2014

(54) LOW AIR CONDITIONING REFRIGERANT DETECTION METHOD

(75) Inventors: Mark G. Smith, Canton, MI (US); Trent G. Sutherland, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 520 days.

(21) Appl. No.: 13/172,192

(22) Filed: Jun. 29, 2011

(65) Prior Publication Data

US 2013/0002446 A1 Jan. 3, 2013

(51) Int. Cl.

| | |
|---|---|
| ***G08B 5/00*** | (2006.01) |
| ***G01K 13/00*** | (2006.01) |
| ***G01M 1/38*** | (2006.01) |
| ***G05B 13/00*** | (2006.01) |
| ***G05B 15/00*** | (2006.01) |
| ***F25B 49/00*** | (2006.01) |

(52) U.S. Cl.

CPC ..... *F25B 49/005* (2013.01); *F25B 2700/21173* (2013.01); *F25B 2700/21175* (2013.01)

USPC ..... 340/815.4; 62/129; 700/276

(58) Field of Classification Search

USPC ..... 340/815.4; 700/276; 62/129

See application file for complete search history.

(56) References Cited

U.S. PATENT DOCUMENTS

| | | | | |
|---|---|---|---|---|
| 3,534,601 | A * | 10/1970 | Grob | 73/204.13 |
| 4,265,091 | A * | 5/1981 | Kobayashi | 62/126 |
| 5,150,584 | A * | 9/1992 | Tomasov et al. | 62/209 |
| 6,055,819 | A * | 5/2000 | Kang | 62/184 |
| 6,220,041 | B1 * | 4/2001 | Okazaki et al. | 62/149 |
| 6,260,363 | B1 * | 7/2001 | Ye et al. | 62/89 |
| 6,330,802 | B1 * | 12/2001 | Cummings et al. | 62/129 |
| 7,146,819 | B2 * | 12/2006 | Demuth et al. | 62/129 |
| 8,537,018 | B2 * | 9/2013 | Bair et al. | 340/585 |
| 8,555,660 | B2 * | 10/2013 | Takenaka et al. | 62/126 |
| 2004/0103673 | A1 * | 6/2004 | Hong | 62/129 |
| 2004/0146085 | A1 * | 7/2004 | Lindner et al. | 374/109 |
| 2004/0159114 | A1 | 8/2004 | Demuth et al. | |
| 2004/0177628 | A1 | 9/2004 | Kurata et al. | |
| 2005/0109050 | A1 | 5/2005 | Laboe et al. | |
| 2007/0220908 | A1 * | 9/2007 | Takahashi | 62/133 |
| 2008/0315000 | A1 * | 12/2008 | Gorthala et al. | 236/46 C |

FOREIGN PATENT DOCUMENTS

| | | |
|---|---|---|
| EP | 1787838 B1 | 10/1998 |

* cited by examiner

*Primary Examiner* — Daniel Wu
*Assistant Examiner* — Mohamed Barakat
(74) *Attorney, Agent, or Firm* — David Kelley, Esq.; Tung & Associates

(57) ABSTRACT

A low air conditioning refrigerant detection method for a vehicle air conditioning system includes measuring an evaporator core outlet refrigerant temperature, measuring an evaporator core outlet air thermistor temperature, calculating a refrigerant to air temperature delta value based on difference between the evaporator core outlet refrigerant temperature and the evaporator core outlet air thermistor temperature and determining system refrigerant charge level based on the refrigerant to air temperature delta value.

16 Claims, 4 Drawing Sheets

LOW AIR CONDITIONING REFRIGERANT DETECTION METHOD

FIELD

The disclosure generally relates to detection of low refrigerant charge level in vehicle air conditioning systems. More particularly, the disclosure relates to a low air conditioning refrigerant detection method in which low levels of refrigerant are detected using a difference between evaporator air outlet temperature and evaporator outlet refrigerant temperature.

BACKGROUND

Under circumstances in which a vehicle AC (air conditioning) system runs low on refrigerant (known as a low refrigerant "charge"), lubrication of the AC compressor may be reduced, potentially causing damage to the compressor. Additionally, the refrigerant discharge temperature may rise, also potentially damaging the compressor. These factors may necessitate expensive repair or replacement of the compressor. The repair or replacement expense may be particularly high in the case of an electric compressor.

Current methods of detecting a low A/C system refrigerant charge may include utilization of a low side pressure switch and a continuous saturation pressure check. However, these methods may not be highly effective in detecting a low state of refrigerant charge under a number of conditions. For example, a low side pressure switch can be set to trip when the suction pressure reaches a lower limit and sends a signal that shuts down the compressor until the pressure climbs above an upper pressure limit. The saturation pressure check occurs on a continuous basis and uses an ambient temperature sensor to determine the saturation pressure of R-134a at that temperature and compares it to the current system head pressure, measured with a transducer. If the head pressure is below the saturation pressure at a given temperature, then the compressor is disabled.

SUMMARY

The disclosure is generally directed to a low AC refrigerant detection method for a vehicle air conditioning system. An illustrative embodiment of the method includes measuring an evaporator core outlet refrigerant temperature, measuring an evaporator core outlet air thermistor temperature, calculating the difference and determining system refrigerant charge level.

In some embodiments, the low AC refrigerant detection method for a vehicle air conditioning system may include determining whether an evaporator core temperature target is within a predetermined evaporator core temperature range; if the evaporator core temperature target is within the predetermined evaporator core temperature range, determining stability of at least one of the following: compressor speed, HVAC blower speed, vehicle speed and engine cooling fan speed; and if at least one of the compressor speed, the HVAC blower speed, the vehicle speed or the fan speed is stable, performing the following steps: measuring an evaporator core outlet refrigerant temperature; measuring an evaporator core outlet air thermistor temperature; calculating the difference and determining system refrigerant charge level.

In some embodiments, the low refrigerant detection method for a vehicle air conditioning system may include measuring an evaporator core outlet refrigerant temperature; measuring an evaporator core outlet air thermistor temperature; calculating a delta value; determining stability of vehicle speed and compressor speed; checking the delta value against a table of values of delta values for a given ambient temperature; setting a counter if the delta value is greater than a checked value for a given ambient temperature; and taking at least one step to prevent damage to an AC compressor, if the number of counts exceeds at least one predetermined count level.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention, which is defined by the claims. Furthermore, there is no intention to be bound by any expressed or implied theory presented in the preceding technical field, background, brief summary or the following detailed description.

Figure 1:
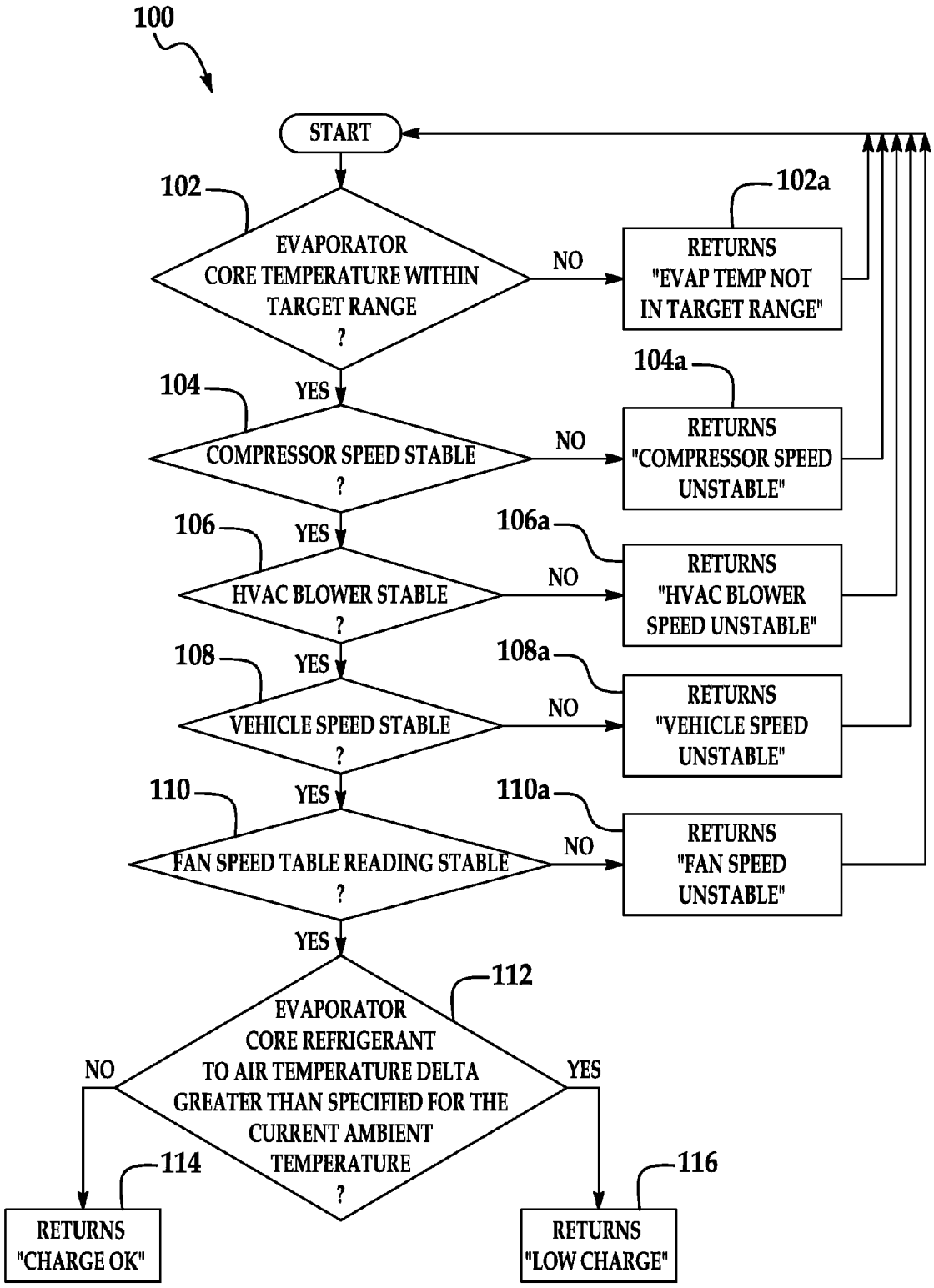
FIG. 1 is a flow diagram which illustrates an algorithm for determining the charge status of refrigerant in an air conditioning compressor according to an illustrative embodiment of the low AC refrigerant detection method.

Referring initially to FIG. 1, an algorithm 100 for determining the charge status of refrigerant in an air conditioning compressor according to an illustrative embodiment of the low AC refrigerant detection method is shown. The method may be applicable to determining the charge status of refrigerant in vehicle AC (Air Conditioning) compressors such as those in HEV (Hybrid Electric Vehicle) electric compressors and conventional compressor systems, for example and without limitation. The method begins at block 101. In block 102, a determination may be made as to whether the evaporator core air temperature is within a predetermined temperature range of the target value, which is determined by the climate control module. The evaporator core air temperature value may be determined by measurement of the evaporator core air temperature thermistor used by the climate control module and powertrain control module of the vehicle. If the evaporator core temperature is not within the predetermined temperature range near the target value, a return which indicates that the evaporator core temperature is not in range may be made in block 102*a*.

If the evaporator core temperature is within the predetermined evaporator core temperature range in block 102, a determination may be made as to whether the compressor speed is stable in block 104. If the compressor speed is not stable in block 104, a return which indicates that the compressor speed is unstable may be made in block 104*a*. If the compressor speed is stable in block 104, a determination may be made as to whether the HVAC (Heating, Ventilating and Air Conditioning) blower speed is stable in block 106. If the HVAC blower is not stable in block 106, a return which indicates that the HVAC blower speed is unstable may be made in block 106*a*.

If the HVAC blower speed is stable in block 106, a determination may be made as to whether the vehicle speed is stable in block 108. If the vehicle speed is not stable, a return which indicates that the vehicle speed is unstable may be made in block 108*a*. If the vehicle speed is stable in block 108, a determination may be made as to whether the engine cooling fan speed is stable in block 110. If the engine cooling fan speed is not stable, a return which indicates that the fan speed is unstable may be made in block 110*a*.

If the fan speed is stable in block 110, the ambient temperature around the vehicle may be measured, and a value for the refrigerant to air temperature delta may be calculated in block 112. A determination may be made as to whether the value for refrigerant to air temperature delta is greater than threshold value, which is found by a function or look up table. If the value for refrigerant to air temperature delta is greater than the threshold value, the refrigerant charge is low (block 116). If the value for refrigerant air temperature delta is not greater than the threshold value, the refrigerant charge is OK (block 114).

The algorithm 100 may be applicable to both outside and recirculation air modes of the vehicle AC system. Due to charge levels tested, the algorithm 100 was calibrated to detect low charge at 40% charge level.

Figure 2:
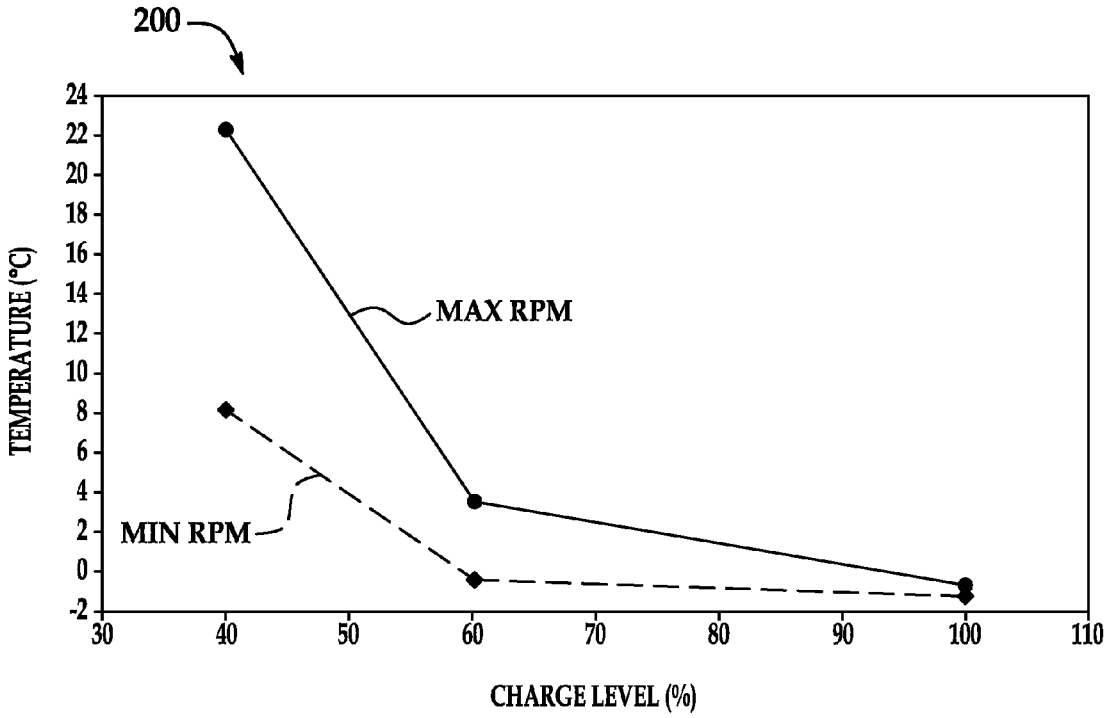
FIG. 2 is a graph which illustrates evaporator core outlet refrigerant to air temperature delta results at high ambient temperature according to an illustrative embodiment of the low AC refrigerant detection method.
Figure 3:
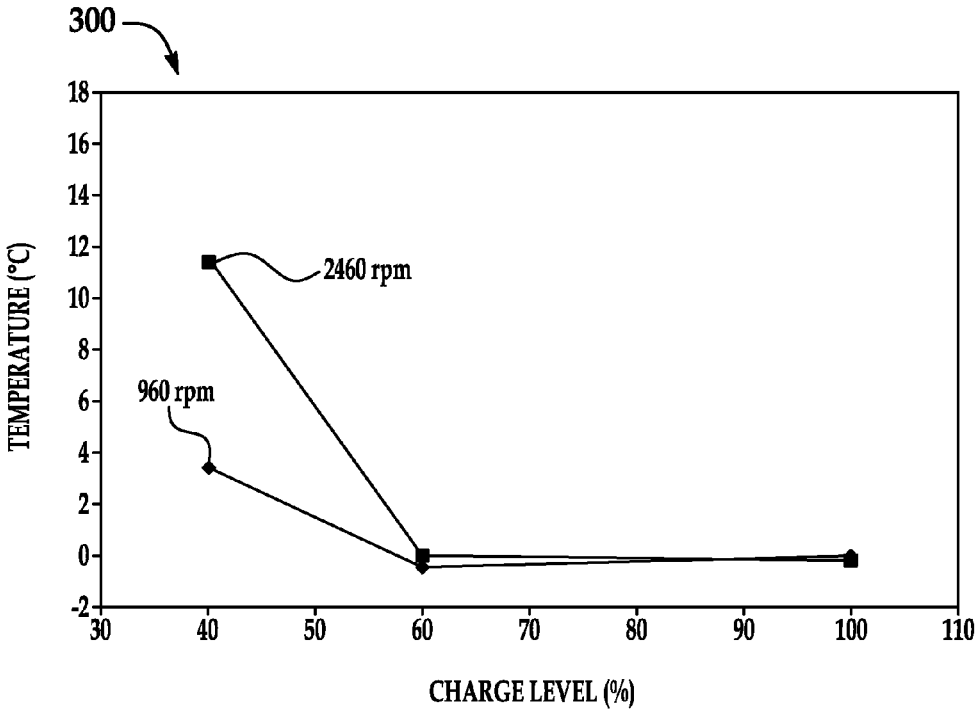
FIG. 3 is a graph which illustrates evaporator core outlet refrigerant to air temperature delta results at a lower ambient temperature according to an illustrative embodiment of the low AC refrigerant detection method.
Figure 4:
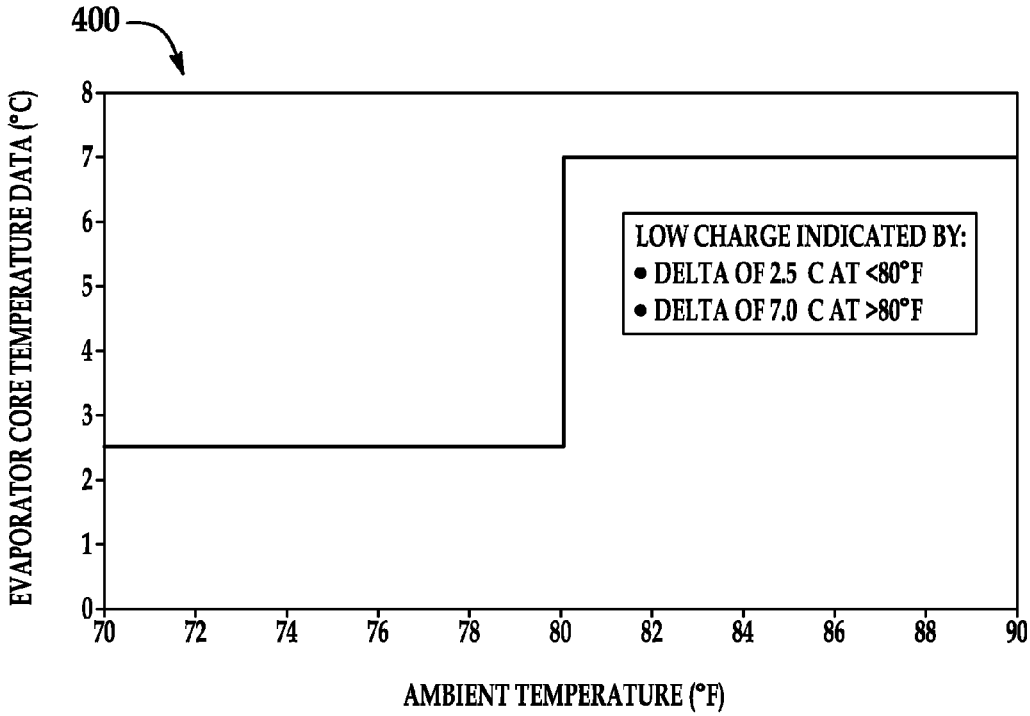
FIG. 4 is an ambient temperature sensitivity function for the evaporator core outlet refrigerant to air temperature delta algorithm according to an illustrative embodiment of the low AC refrigerant detection method.
Figure 5:
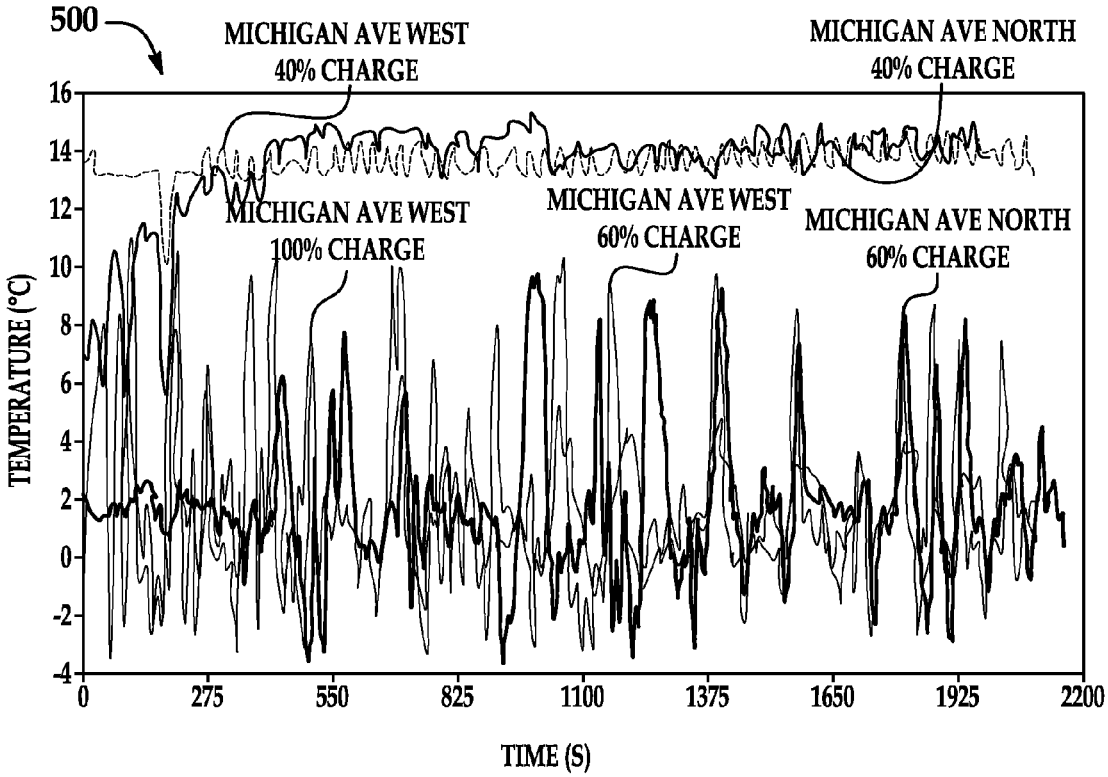
FIG. 5 is a graph which illustrates evaporator core temperature delta results for a given drive cycle in a relative high ambient test condition.

Referring next to FIGS. 2 and 3, a graph 200 which illustrates evaporator core refrigerant to air temperature delta results at high ambient temperature according to an illustrative embodiment of the low AC refrigerant detection method is shown in FIG. 2. A graph 300 which illustrates evaporator core refrigerant to air temperature delta results at a lower ambient temperature is shown in FIG. 3. Referring next to FIG. 4, an ambient temperature sensitivity function 400 for the evaporator core refrigerant to air temperature delta algorithm according to an illustrative embodiment of the low AC refrigerant detection method is shown. This curve is determined by examining the test data at the 40% charge level. It is shown in a generic method; such data could be used in a non-linear, or look-up table format as well, for example. Referring next to FIG. 5, a graph 500 which illustrates evaporator core refrigerant to air temperature delta results for drive cycles in a relatively warm day is shown. The graph 500 illustrates that nearly all of the 40% charge has a distinct separation from the higher charge levels, and is above a threshold for that test condition.

Figure 6:
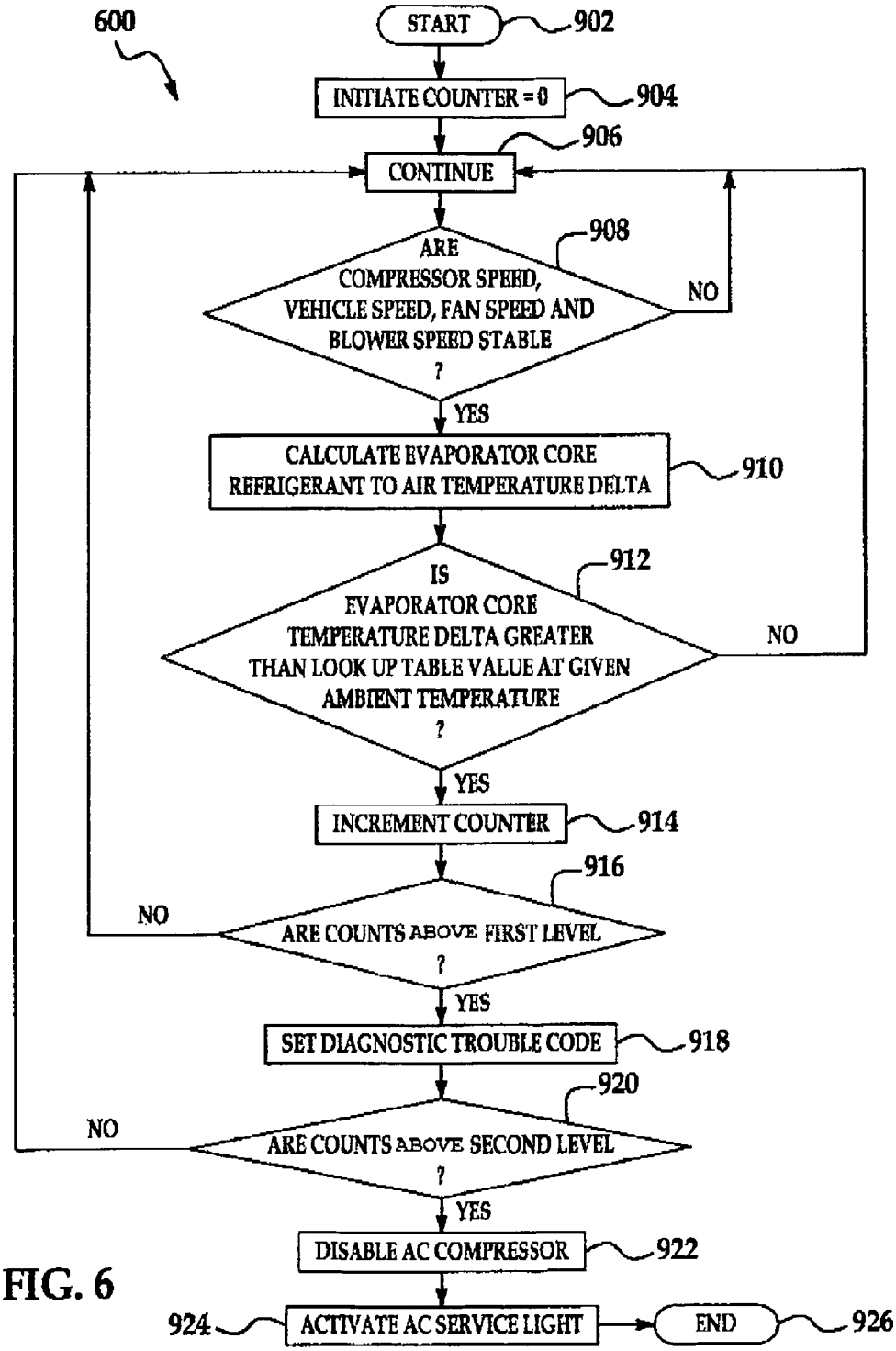
FIG. 6 is a flow diagram which illustrates implementation of solutions to a low charge of refrigerant in an air conditioning compressor according to an illustrative embodiment of the low AC refrigerant detection method.

Referring next to FIG. 6, a flow diagram 600 which illustrates implementation of solutions to a low charge of refrigerant in an air conditioning compressor according to an illustrative embodiment of the low AC refrigerant detection method is shown. The method begins at block 902. In block 904, an event counter is initialized. In block 908, a determination may be made as to whether the vehicle speed and the compressor speed are stable. If the vehicle speed and the compressor speed are not stable, the method may return to block 906. If the vehicle speed and the compressor speed are stable, the refrigerant to air temperature delta may be calculated in block 910. The temperature delta may be determined by measuring an evaporator core outlet refrigerant temperature, measuring the evaporator core outlet air thermistor temperature, and calculating the difference.

In block 912, a determination may be made as to whether the refrigerant to air temperature delta is greater than the threshhold value for the given ambient temperature. If the temperature delta is not greater than the threshhold value for the given ambient temperature, the method may return to block 906. If the temperature delta is greater than the checked value for the given ambient temperature, a counter may be incremented in block 914. In block 916, a determination may be made as to whether the counts are above a first predetermined count level. If the counts are not above the first predetermined count level, the method may return to block 906. If the counts are above the first predetermined count level, a DTC (Diagnostic Trouble Code) may be set in block 918. In block 920, a determination may be made as to whether the counts are above a predetermined second count level. If the counts are not above the second count level, the method may return to block 906. If the counts are above the second count level, the compressor may be disabled in block 922. In block 924, an AC service light may be activated or other notification method may be used to convey the message to the vehicle operator.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A method of detecting low air conditioning refrigerant in a vehicle air conditioning system, comprising the steps of:

measuring an outlet refrigerant temperature of an evaporator core;

measuring an outlet air thermistor temperature of said evaporator core;

measuring a current ambient temperature;

calculating a temperature delta value based on difference between said evaporator core outlet refrigerant temperature and said evaporator core outlet air thermistor temperature; and determining system refrigerant charge level based on said temperature delta value and said current ambient temperature.

2. The method of claim 1 wherein the steps of determining system refrigerant charge level based on said refrigerant to air temperature delta value further comprises determining an acceptable refrigerant charge level if said refrigerant to air temperature delta value is not greater than a temperature determined based on the current ambient temperature.

3. The method of claim 1 wherein the steps of determining system refrigerant charge level based on said refrigerant to air temperature delta value further comprises determining a low refrigerant charge level if said refrigerant to air temperature delta value is greater than a temperature determined based on the current ambient temperature.

4. The method of claim 1 further comprising disabling a compressor if said air temperature delta value exceeds a predetermined value.

5. The method of claim 4 further comprising activating an air conditioning service light.

6. A method for detecting low air conditioning refrigerant in a vehicle air conditioning system, comprising the steps of:

determining whether an evaporator core temperature is within a predetermined evaporator core temperature range;

if said evaporator core temperature is within said predetermined evaporator core temperature range, determining stability of at least one of the following: compressor speed, HVAC blower speed, vehicle speed and fan speed; and if at least one of said compressor speed, said HVAC blower speed, said vehicle speed and said fan speed is stable, performing the following steps:

measuring an outlet refrigerant temperature of said evaporator core;

measuring an outlet air thermistor temperature of said evaporator core;

measuring a current ambient temperature;

calculating a refrigerant to air temperature delta value based on difference between said evaporator core outlet refrigerant temperature and said evaporator core outlet air thermistor temperature; and determining system refrigerant charge level based on said temperature delta value and said current ambient temperature.

7. The method of claim 6 further comprising wherein said performing the steps if at least one of said compressor speed, said HVAC blower speed, said vehicle speed and said fan speed is stable comprises performing the steps if the ambient temperature exceeds a predetermined temperature.

8. The method of claim 6 wherein said performing the following steps comprises performing the steps if said ambient temperature exceeds said predetermined temperature and said compressor speed, said HVAC blower speed, said vehicle speed and said fan speed are stable.

9. The method of claim 6 wherein determining system refrigerant charge level based on said refrigerant to air temperature delta value comprises determining an acceptable refrigerant charge level if said refrigerant to air temperature delta value is not greater than a temperature determined based on the current ambient temperature.

10. The method of claim 9 wherein determining system refrigerant charge level based on said refrigerant to air temperature delta value comprises determining a low refrigerant charge level if said refrigerant to air temperature delta value is greater than a temperature determined based on the current ambient temperature.

11. The method of claim 6 further comprising disabling a compressor if said refrigerant to air temperature delta value exceeds a predetermined value.

12. The method of claim 11 further comprising activating an air conditioning service light.

13. A method for detecting low refrigerant in a vehicle air conditioning system, comprising the steps of:

measuring an outlet refrigerant temperature of an evaporator core;

measuring an outlet air thermistor temperature of said evaporator core;

measuring a current ambient temperature;

calculating a refrigerant to air temperature delta value based on difference between said evaporator core outlet refrigerant temperature and said evaporator core outlet air thermistor temperature;

determining stability of vehicle speed and compressor speed;

checking said refrigerant to air temperature delta value against a table of values of temperature delta values for said current ambient temperature;

incrementing a counter if said temperature delta value is greater than a checked value of said temperature delta values for said current ambient temperature; and taking at least one step to prevent damage to an air conditioning compressor if number of counts exceeds at least one predetermined count level.

14. The method of claim 13 wherein said taking at least one step to prevent damage to an air conditioning compressor if number of counts exceeds at least one predetermined count level comprises setting a diagnostic trouble code (DTC).

15. The method of claim 14 wherein said taking at least one step to prevent damage to an air conditioning compressor if number of counts exceeds at least one predetermined count level further comprises disabling said air conditioning compressor.

16. The method of claim 15 further comprising activating an air conditioning service light.

* * * * *